US010826225B2

(12) United States Patent
Cao et al.

(10) Patent No.: US 10,826,225 B2
(45) Date of Patent: Nov. 3, 2020

(54) WATERPROOF AUDIO JACK

(71) Applicants: FU DING PRECISION INDUSTRIAL (ZHENGZHOU) CO.,LTD., Zhengzhou (CN); FOXCONN INTERCONNECT TECHNOLOGY LIMITED, Grand Cayman (KY)

(72) Inventors: Qin-Xin Cao, Kunshan (CN); De-Jin Chen, Kunshan (CN)

(73) Assignees: FU DING PRECISION INDUSTRIAL (ZHENGZHOU) CO., LTD., Zhengzhou (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/554,606

(22) Filed: Aug. 28, 2019

(65) Prior Publication Data

US 2020/0076115 A1 Mar. 5, 2020

(30) Foreign Application Priority Data

Aug. 29, 2018 (CN) ..... 2018 2 1407711 U

(51) Int. Cl.

| | |
|---|---|
| ***H01R 13/52*** | (2006.01) |
| ***H01R 24/58*** | (2011.01) |
| ***H01R 13/502*** | (2006.01) |
| ***H01R 43/00*** | (2006.01) |
| ***H01R 43/20*** | (2006.01) |
| *H01R 107/00* | (2006.01) |
| *H01R 12/58* | (2011.01) |
| *H04R 3/00* | (2006.01) |

(52) U.S. Cl.

CPC ..... *H01R 13/521* (2013.01); *H01R 13/502* (2013.01); *H01R 13/5219* (2013.01); (Continued)

(58) Field of Classification Search

CPC ..... H01R 13/521; H01R 13/502; H01R 13/5219; H01R 24/58; H01R 43/005; H01R 43/20; H01R 12/58; H01R 210/00

(Continued)

(56) References Cited

U.S. PATENT DOCUMENTS 6,595,804 B2 * 7/2003 Nagata ..... H01R 24/58 439/668
7,637,787 B2 * 12/2009 Chien ..... H01R 24/58 439/668

(Continued)

FOREIGN PATENT DOCUMENTS

CN 2667742 Y 12/2004
CN 201797146 U 4/2011

(Continued)

*Primary Examiner* — Harshad C Patel

(74) *Attorney, Agent, or Firm* — Wei Te Chung; Ming Chieh Chang

(57) ABSTRACT

An audio jack includes an insulative housing, and a plurality of contacts retained to the housing. The housing forms a main body, a mating port with a mating cavity therein. The main body forms a plurality of contacts receiving passageways extending from a bottom side of the housing and transversely communicating with the mating cavity. The contact has a contacting section extending into the mating cavity, and a soldering leg extending outside of the housing. A bottom cover is attached upon the bottom side of the housing. A waterproof plate is applied upon a bottom face of the bottom cover to seal the gaps among the housing the bottom cover and the soldering legs.

13 Claims, 10 Drawing Sheets

(52) U.S. Cl.
CPC ..... *H01R 24/58* (2013.01); *H01R 43/005* (2013.01); *H01R 43/20* (2013.01); *H01R 12/58* (2013.01); *H01R 2107/00* (2013.01); *H04R 3/00* (2013.01); *H04R 2420/05* (2013.01)

(58) Field of Classification Search
USPC ..... 439/621, 271, 521
See application file for complete search history.

(56) References Cited

U.S. PATENT DOCUMENTS

| | | | | |
|---|---|---|---|---|
| 9,219,330 | B2 * | 12/2015 | Shin | H01R 13/60 |
| 9,531,111 | B2 * | 12/2016 | Chen | H01R 13/5213 |
| 2013/0065445 | A1 * | 3/2013 | Nagata | H01R 24/58 439/625 |
| 2013/0183844 | A1 * | 7/2013 | Wang | H01R 24/68 439/271 |
| 2013/0244497 | A1 * | 9/2013 | Zhang | H01R 24/58 439/676 |
| 2017/0093081 | A1 * | 3/2017 | Yang | H01R 13/5202 |

FOREIGN PATENT DOCUMENTS

| | | | |
|---|---|---|---|
| CN | 203850524 | U | 9/2014 |
| CN | 204144560 | U | 2/2015 |
| CN | 102148458 | B | 5/2015 |
| CN | 106558818 | A | 4/2017 |

* cited by examiner

WATERPROOF AUDIO JACK

BACKGROUND OF THE INVENTION

1. Field of the Invention

The present invention relates generally to an electrical connector, and particularly to a waterproof audio jack.

2. Description of Related Arts

U.S. Pat. Nos. 8,123,569 and 8,951,073 both disclose the waterproof audio jacks. Anyhow, both two designs may have some drawbacks in economic manufacturability.

It is desirable to provide a waterproof audio jack with the robust structure and equipped with a reliable waterproof mechanism in an easy manufacturing way.

SUMMARY OF THE INVENTION

An object of the invention is to provide an audio jack with an insulative housing, and a plurality of contacts retained to the housing. The housing forms a main body, a mating port with a mating cavity therein. The main body forms a plurality of contacts receiving passageways extending from a bottom side of the housing and transversely communicating with the mating cavity. The contact has a contacting section extending into the mating cavity, and a soldering leg extending outside of the housing. A bottom cover is attached upon the bottom side of the housing. A waterproof plate is applied upon a bottom face of the bottom cover to seal the gaps among the housing the bottom cover and the soldering legs.

DETAILED DESCRIPTION OF THE PREFERRED EMBODIMENT

Figure 1:
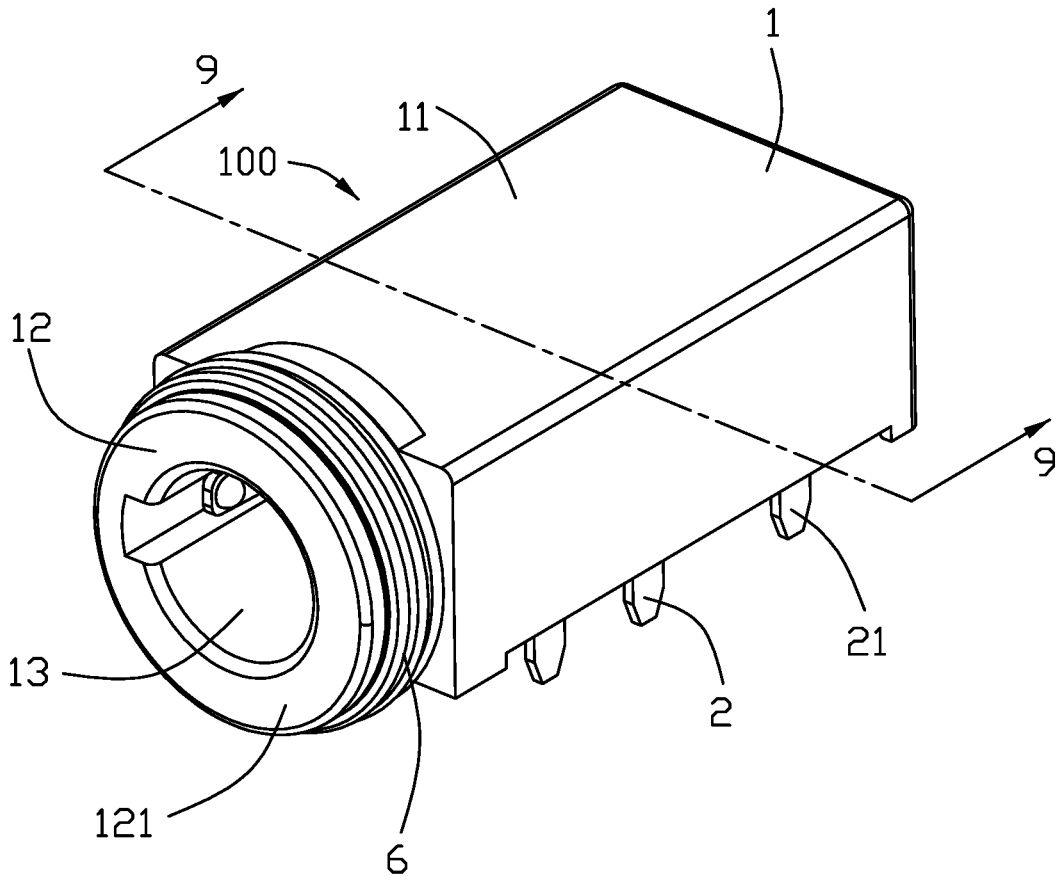
FIG. 1 is a perspective view of an audio jack according to the invention.
Figure 2:
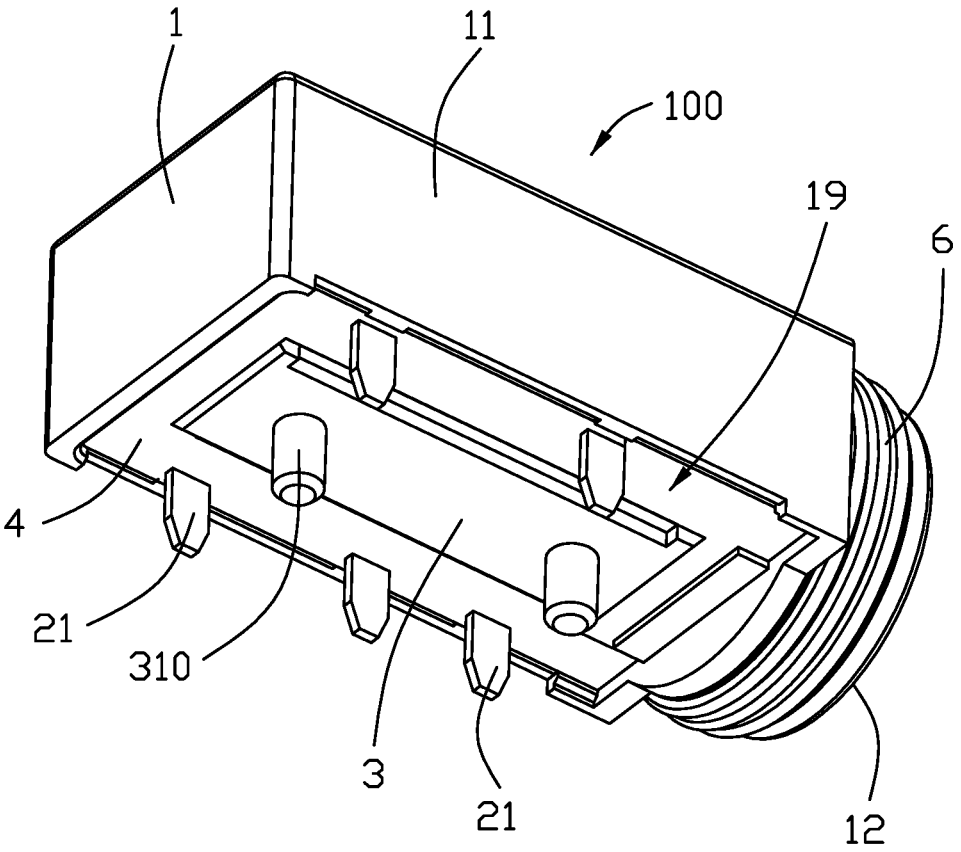
FIG. 2 is another perspective view of the audio jack of FIG. 1.
Figure 3:
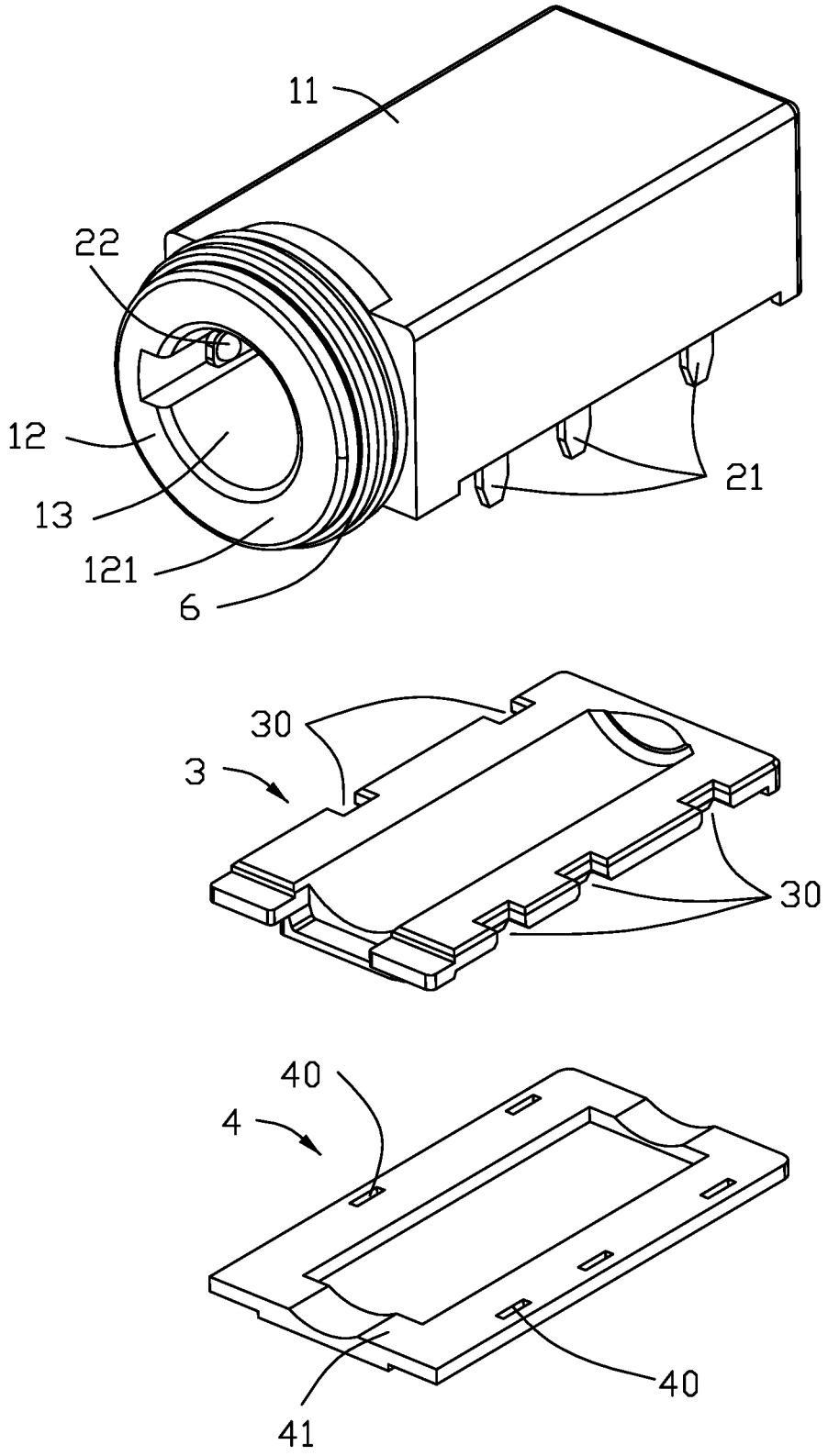
FIG. 3 is an exploded perspective view of the audio jack of FIG. 1.
Figure 4:
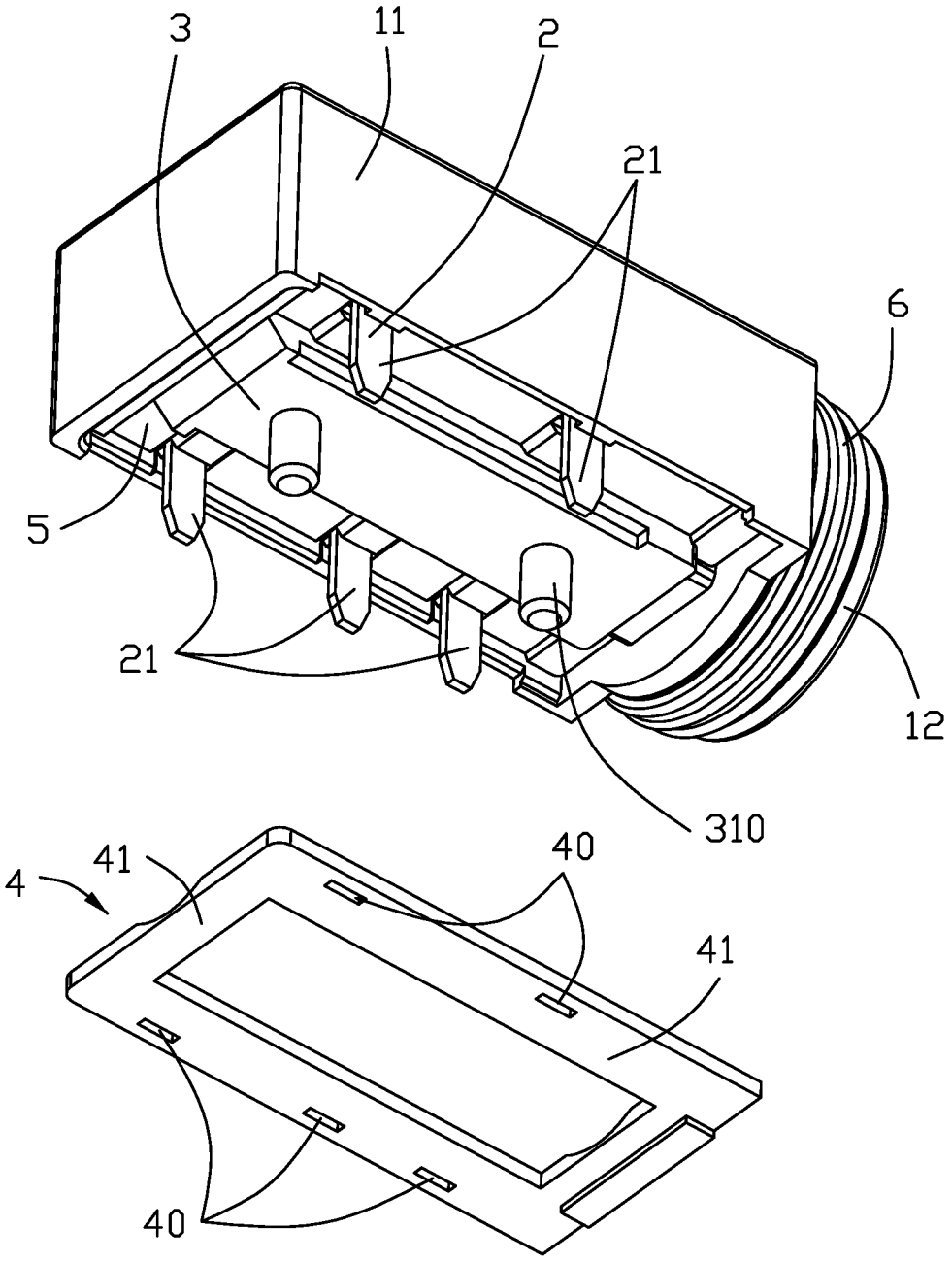
FIG. 4 is another exploded perspective view of the audio jack of FIG. 1.
Figure 5:
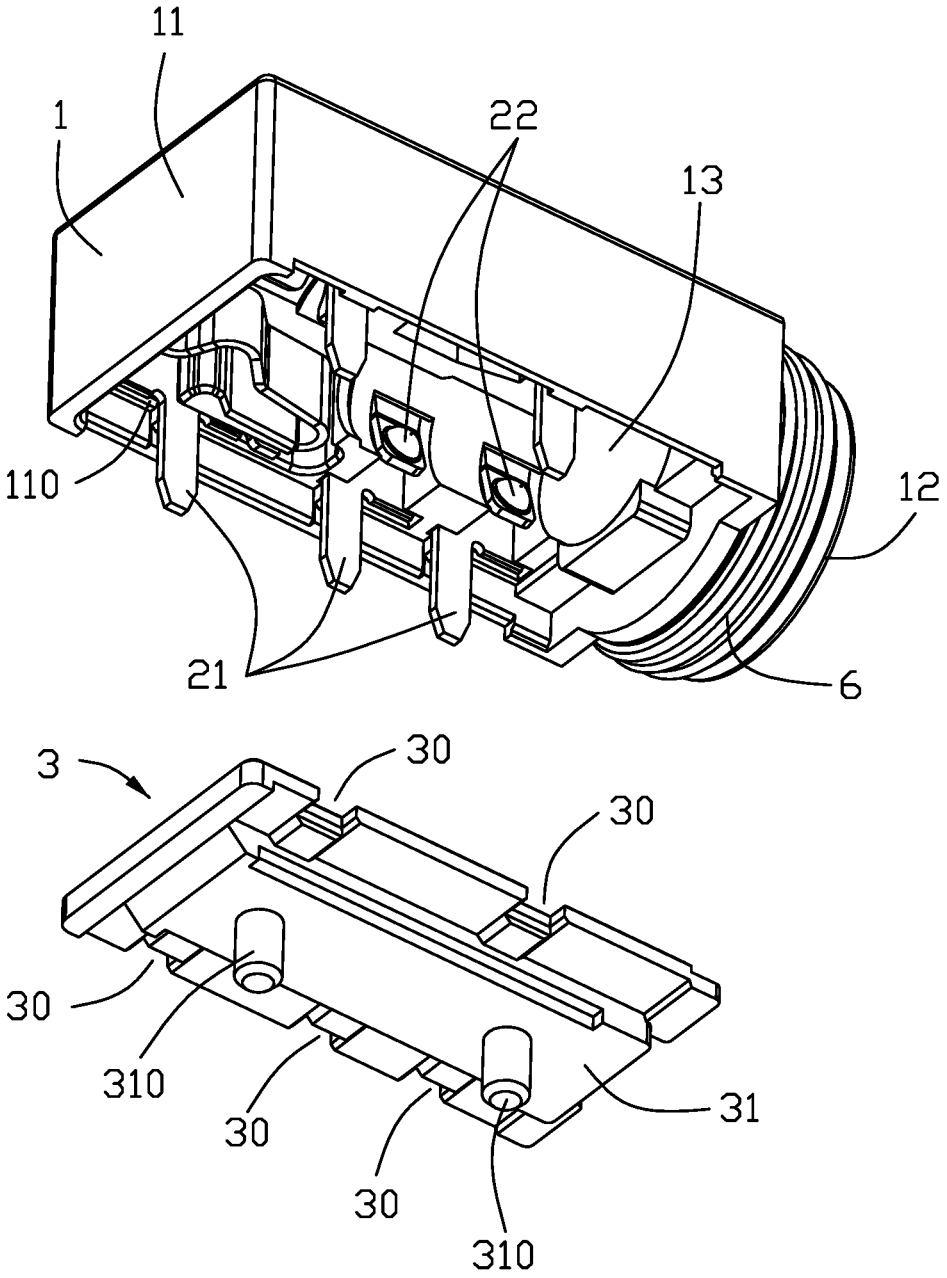
FIG. 5 is a further exploded perspective view of the audio jack of FIG. 4.
Figure 6:
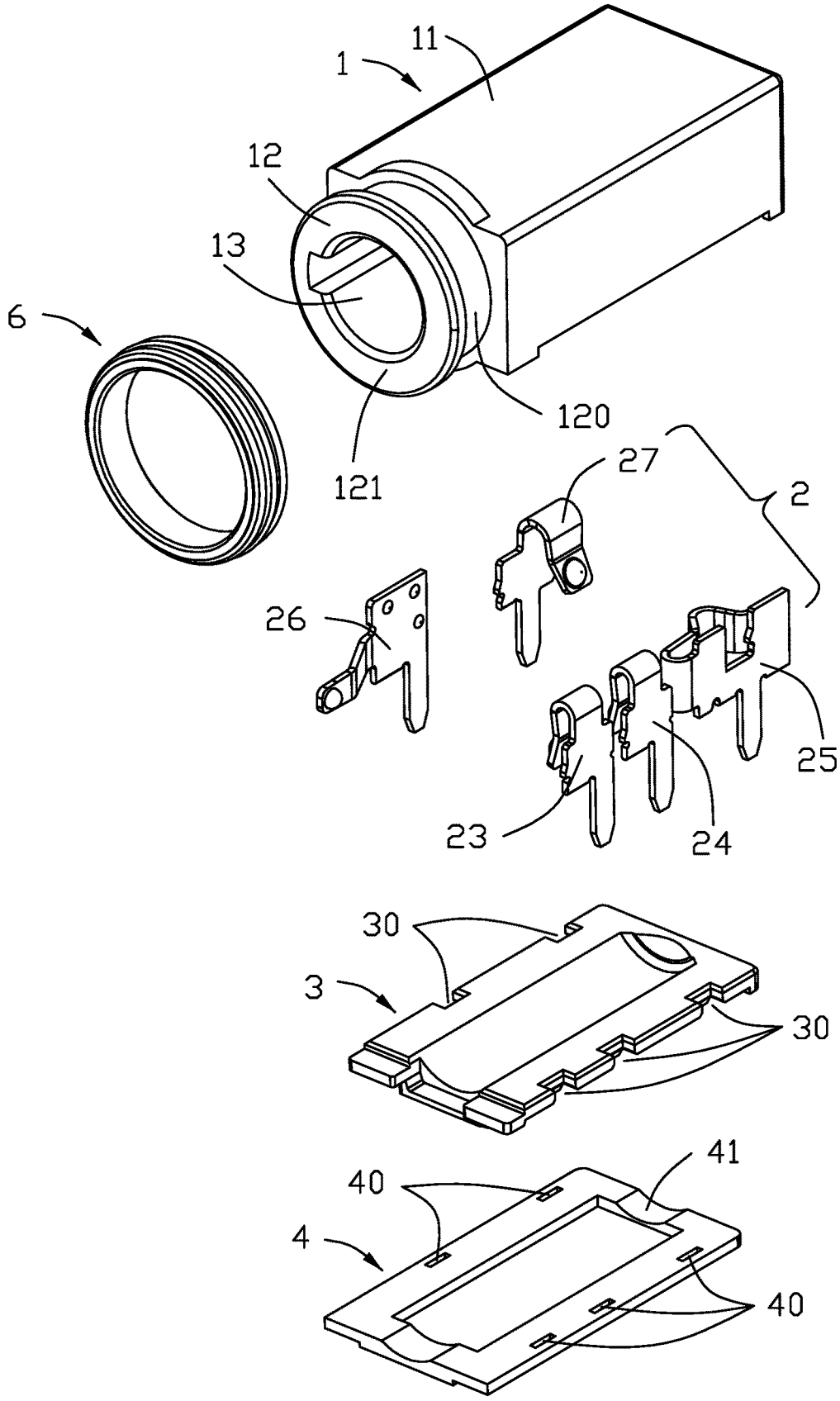
FIG. 6 is a further exploded perspective view of the audio jack of FIG. 5.

Referring to FIGS. 1-9, an electrical connector 100 for mounting to a printed circuit board (not shown) and mating with a plug connector (not shown), includes an insulative housing 1, a plurality of contacts 2 retained in the housing

1. The housing 1 includes a main body 11, and a mating port 12 extending from the main body 11 with a front face 121 thereon, and a mating cavity 13 formed in both the mating port 12 and the main body 11 for receiving the plug connector. The main body 11 includes a plurality of passageways 110 to receive the corresponding contacts 2, respectively. The passageways 110 extend upwardly from a bottom side of the housing 1 and communicate with the mating cavity 13. The contact 2 includes a soldering leg 21 extending downwardly from the main body 11. An insulative bottom cover 3 is attached upon the bottom side of the housing 1. A waterproof plate 4 is applied upon a bottom face of the bottom cover 3 so as to seal the gaps among the main body 11, the bottom cover 3 and the soldering legs 21 of the contacts 2 for preventing humidity from entering the mating cavity 13. The waterproof plate may be glue or epoxy resin solidified from the liquid form.

Figure 9:
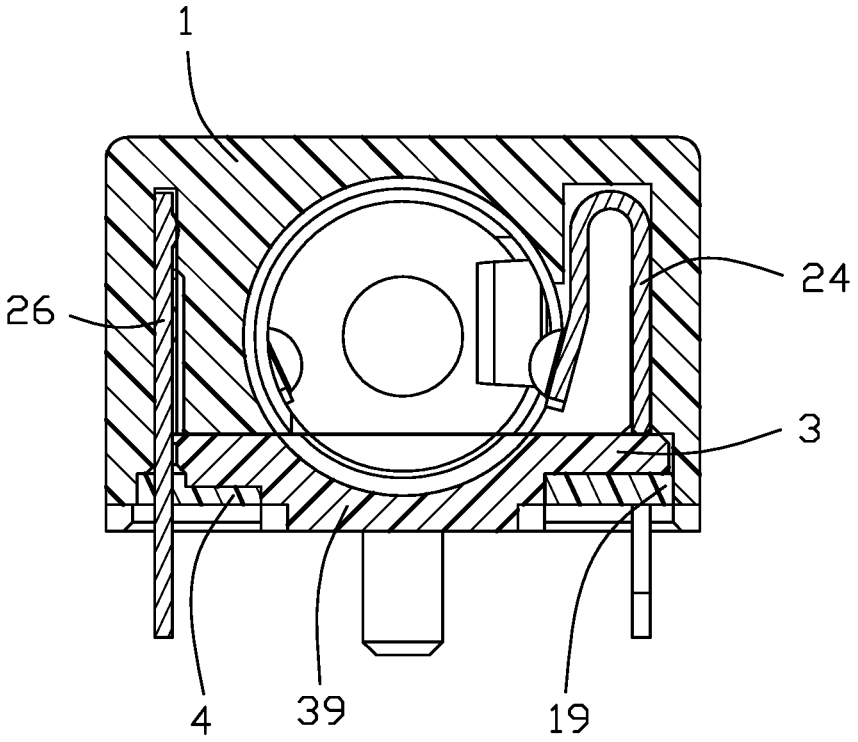
FIG. 9 is a cross-sectional view to show how the contact is sandwiched between the bottom cover and the housing, and the waterproof plate is received within a recess formed in the housing below the bottom cover.

The contact 2 includes a deflectable contacting section 22 extending into the mating cavity 13, and a barbed retention section (not labeled) located between the contacting section 22 and the soldering leg 21. The soldering legs 21 are arranged in two rows respectively located on two lateral sides of the housing 1 in the transverse direction. The bottom cover 3 is essentially located between the two rows of the soldering legs 21. Specifically, the bottom cover 3 forms two rows of notches/apertures 30 to receive the corresponding soldering legs 21, respectively. In this embodiment, the soldering leg 21 is sandwiched between the corresponding side wall of the main body 11 and the side edge of the bottom cover 3 in the transverse direction. Notably, the soldering leg 21 may be retained by only the bottom cover 3 if the corresponding notches 30 are the so-called through holes in which the corresponding soldering leg 21 is fully circumferentially enclosed. As shown in FIG. 9, the bottom cover 3 has a downward protruding island 39. The waterproof plate 4 has a frame structure 41 surrounding the protruding island. Notably, as shown in FIG. 9, the main body 11 forms a recess 19 under the bottom cover 3 so as to receive the waterproof 4 therein. The waterproof plate 4 includes a plurality of through holes 40 in which the soldering legs 21 are intimately surrounded and through which the soldering legs extend downwardly.

The contact 2 is upwardly assembled into the corresponding passageway 110 from the bottom side of the housing 1. The bottom cover 3 is upwardly assembled upon the bottom side of the housing 1 after the contacts have been assembled into the housing 1. There are gaps 5 located in the bottom side of the housing 1. Because it is impossible without gaps between the bottom cover 3 and the housing 1, and between the soldering legs 21 and the bottom cover 3 or the housing 1, the waterproof plate 4 is requisitely applied upon a bottom face of the bottom cover 3 so as to fill those gaps. Because the center region of the bottom cover 3 is essentially a complete and unitary piece without any gaps with other parts, the waterproof plate 4 is not required to be applied thereupon. This is one reason why the downwardly protruding island 39 is formed on the bottom cover 3 so as to exclude the waterproof material during forming the waterproof plate 4. Another reason for forming the downwardly protruding island 39 is to reinforce the strength of the posts 31 illustrate later. In this embodiment, the contacts 2 include the grounding contacts 26, 27, the signal contact 23, the contact 24 for microphone, and the detecting contact 25.

The housing 1 and the bottom cover 3 share the same material for assuring balanced strength distribution. The mating port 12 is of a fully circumferential structure without involving the boundary lines between the main body 11 and the bottom cover 3 so as to achieve the best strength thereof. A pair of downwardly extending posts 310 are formed on the downwardly protruding island 39 for mounting to the printed circuit board (not shown).

Figure 7:
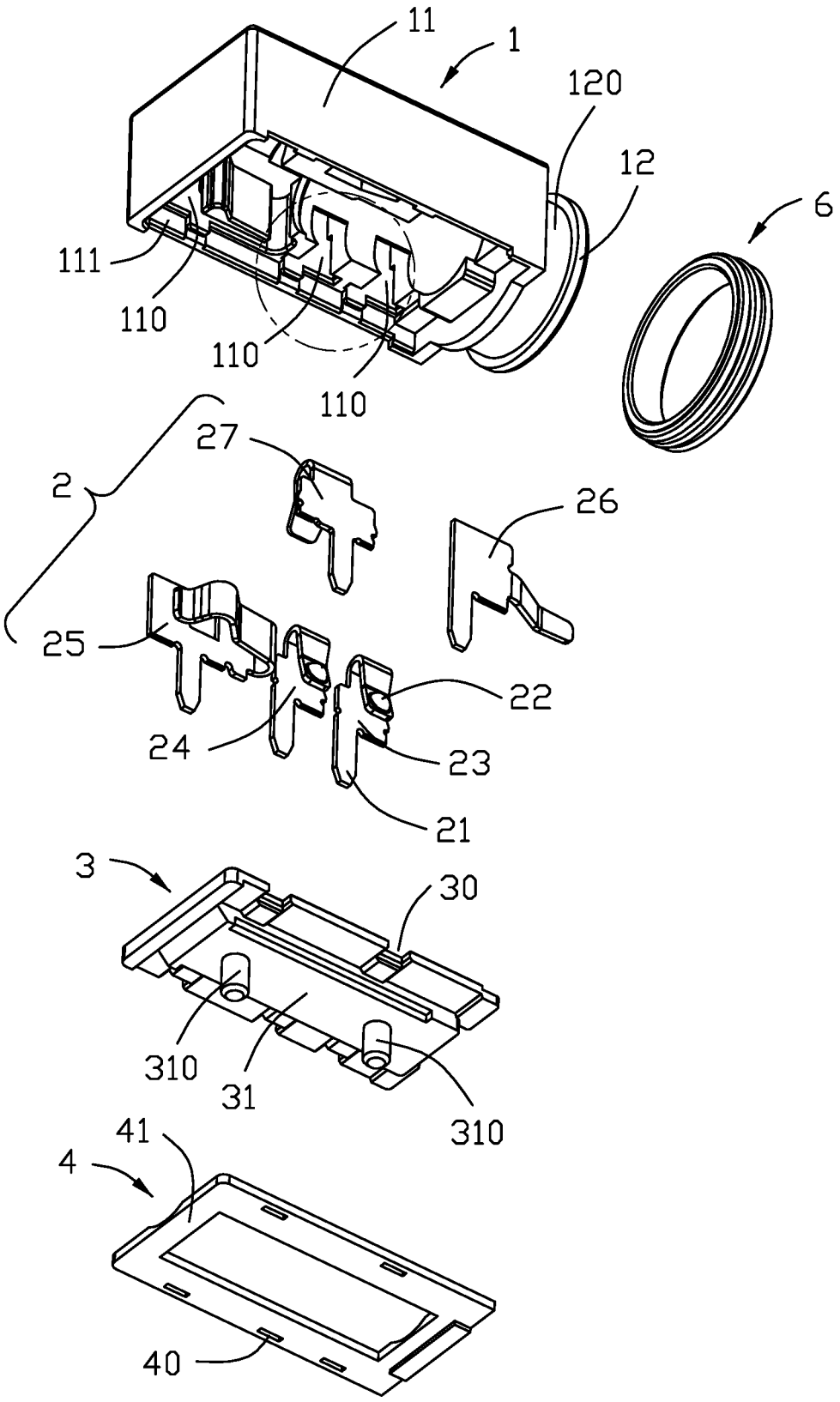
FIG. 7 is another exploded perspective view of the audio jack of FIG. 6.
Figure 7A:
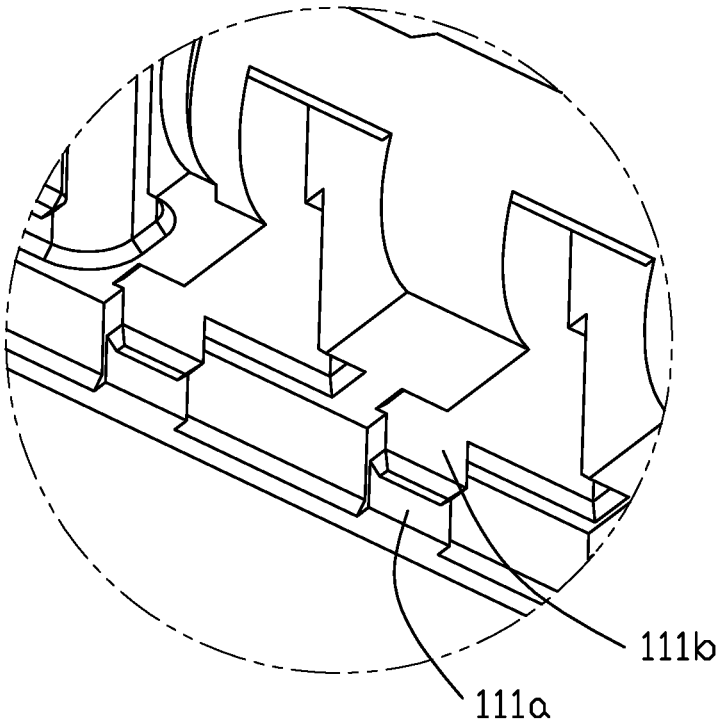
FIG. 7(A) is an enlarged perspective view of a portion of the housing to show the corresponding protrusion against which the contact abuts.
Figure 8:
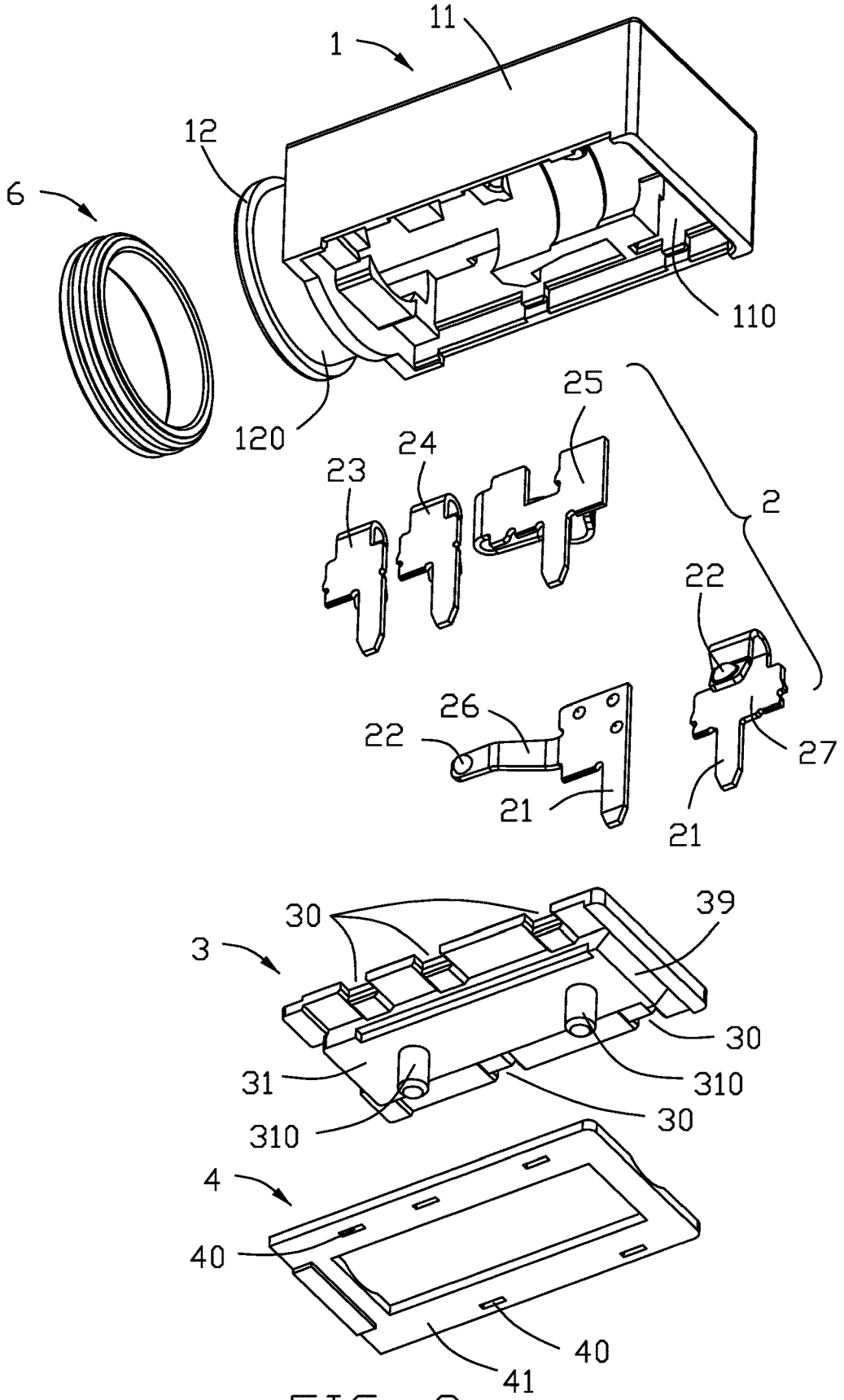
FIG. 8 is another perspective view of the audio jack of FIG. 7.

A waterproof ring 6 is attached upon the mating port 12 for preventing humidity from invading via the gap between the connector 100 and the case of the electrical product, e.g., the cellular phone. The waterproof plate 4 may prevent the humidity from invading via the gap 5. In this embodiment, the ring 6 may be made by rubber or silicon. A ring type groove 120 is formed in an exterior surface of the mating port 12 for retaining the ring 6. As shown in FIG. 7(A), in this embodiment the main body 11 forms a plurality of outer projections 111*a* and inner projections 111*b* in alignment with the corresponding soldering legs 21, respectively, so as to efficiently hold the corresponding soldering legs 21 in position in the transverse direction wherein the soldering leg 21 is intimately sandwiched between the lateral side of the bottom cover 3 and the corresponding inner projection 111*b* in the transverse direction.

What is claimed is:

1. An electrical connector comprising:

an insulative housing including a main body, a mating port forwardly extending from the main body, and a mating cavity formed in both the mating port and the main body and forwardly communicating with an exterior for receiving a plug connector along a front-to-back direction;

a plurality of passageways formed in the main body;

a plurality of contacts retained in the corresponding passageways, respectively, each of said contacts including a deflectable contacting section extending into the mating cavity, a soldering leg extending out of the housing, and a barbed retaining section between the contacting section and the soldering leg to retain the contact in the housing;

an insulative bottom cover attached upon a bottom side of the main body to cover the mating cavity with the corresponding soldering legs sandwiched between the bottom cover and corresponding side walls of the housing in a transverse direction perpendicular to the front-to-back direction; and a waterproof plate disposed in a recess of the housing below the bottom cover and intimately covering a bottom face of the bottom cover; wherein said waterproof plate defines a plurality of through holes in which the corresponding soldering legs are intimately surrounded and through which the corresponding soldering legs extend downwardly.

2. The electrical connector as claimed in claim 1, wherein the waterproof plate is of a frame structure and the bottom cover forms a downwardly protruding island to be received within the frame structure.

3. The electrical connector as claimed in claim 2, wherein at least one downward post is formed on the downwardly protruding island.

4. The electrical connector as claimed in claim 1, wherein the bottom cover forms a plurality of notches in two opposite lateral sides to receive the corresponding soldering legs, respectively.

5. The electrical connector as claimed in claim 1, wherein the main body forms a plurality of outer projections and a plurality of inner projections in aligned with the corresponding soldering legs in the transverse direction, respectively.

6. The electrical connector as claimed in claim 5, wherein the soldering leg is sandwiched between the bottom cover and the corresponding inner projection in the transverse direction.

7. The electrical connector as claimed in claim 1, wherein the passageways extend from the bottom side of the housing so as to allow the corresponding contacts to be assembled thereinto upwardly.

8. An electrical connector comprising:

an insulative housing including a main body, a mating port forwardly extending from the main body, and a mating cavity formed in both the mating port and the main body and forwardly communicating with an exterior for receiving a plug connector along a front-to-back direction;

a plurality of passageways formed in the main body;

a plurality of contacts retained in the corresponding passageways, respectively, each of said contacts including a deflectable contacting section extending into the mating cavity, a soldering leg extending out of the housing, and a barbed retaining section between the contacting section and the soldering leg to retain the contact in the housing;

an insulative bottom cover attached upon a bottom side of the main body to cover the mating cavity and forming a plurality of apertures to receive the corresponding soldering legs, respectively; and a waterproof plate disposed in a recess of the housing below the bottom cover and intimately covering a bottom face of the bottom cover; wherein said waterproof plate defines a plurality of through holes in which the corresponding soldering legs are intimately surrounded and through which the corresponding soldering legs extend downwardly; wherein the waterproof plate is of a frame structure and the bottom cover forms a downwardly protruding island to be received within the frame structure.

9. The electrical connector as claimed in claim 8, wherein at least one downward post is formed on the downwardly protruding island.

10. The electrical connector as claimed in claim 8, wherein the main body forms a plurality of outer projections and a plurality of inner projections in aligned with the corresponding soldering legs in the transverse direction, respectively.

11. The electrical connector as claimed in claim 10, wherein the soldering leg is sandwiched between the bottom cover and the corresponding inner projection in the transverse direction.

12. The electrical connector as claimed in claim 11, wherein a corresponding portions of the waterproof plate is sandwiched between the outer projection and the corresponding soldering leg in the transverse direction.

13. The electrical connector as claimed in claim 8, wherein the passageways extend from the bottom side of the housing so as to allow the corresponding contacts to be assembled thereinto upwardly.

* * * * *